US008485400B2

(12) United States Patent
Kawakami et al.

(10) Patent No.: US 8,485,400 B2
(45) Date of Patent: Jul. 16, 2013

(54) POUCH CONTAINER

(75) Inventors: Souichi Kawakami, Tokyo (JP); Kazumi Ozawa, Tokyo (JP); Koichi Ishizaka, Tokyo (JP); Takayuki Aikawa, Tokyo (JP); Kazuyuki Kurosawa, Tokyo (JP)

(73) Assignee: Toyo Seikan Kaisha, Ltd., Tokyo (JP)

( * ) Notice: Subject to any disclaimer, the term of this patent is extended or adjusted under 35 U.S.C. 154(b) by 1168 days.

(21) Appl. No.: 12/282,097

(22) PCT Filed: Apr. 4, 2007

(86) PCT No.: PCT/JP2007/057929

§ 371 (c)(1),
(2), (4) Date: Sep. 8, 2008

(87) PCT Pub. No.: WO2007/117014

PCT Pub. Date: Oct. 18, 2007

(65) Prior Publication Data

US 2009/0060398 A1 Mar. 5, 2009

(30) Foreign Application Priority Data

Apr. 7, 2006 (JP) ..... 2006-106691

(51) Int. Cl.
*B65D 5/72* (2006.01)

(52) U.S. Cl.
USPC ..... 222/572; 222/107; 222/541.9; 222/564; 206/218; 220/9.2; 220/62.11; 220/674; 383/33; 383/120; 383/207; 383/906

(58) Field of Classification Search
USPC ..... 222/92–107, 386.5, 541.1, 541.6, 222/541.9, 564, 572, 574–575; 206/216–218; 428/34.1, 35.2; 383/33–36, 104, 120, 200, 383/207, 906; 220/9.1–9.3, 62.11–62.22, 220/265–266, 269, 553, 557, 669, 674–675
See application file for complete search history.

(56) References Cited

U.S. PATENT DOCUMENTS

| | | | | |
|---|---|---|---|---|
| 4,717,046 | A * | 1/1988 | Brogli | 222/107 |
| 4,792,060 | A * | 12/1988 | Brogli | 222/107 |
| 5,433,526 | A * | 7/1995 | Wild | 383/35 |
| 6,667,081 | B1 * | 12/2003 | Aoki et al. | 428/34.1 |
| 6,852,244 | B2 * | 2/2005 | Egawa et al. | 252/8.61 |
| 6,986,729 | B2 * | 1/2006 | Ichikawa et al. | 493/213 |

FOREIGN PATENT DOCUMENTS

| | | | |
|---|---|---|---|
| JP | 11-11498 | | 1/1999 |
| JP | 11-314652 | Y | 11/1999 |
| JP | 2002370754 | * | 12/2002 |

* cited by examiner

*Primary Examiner* — Paul R Durand
*Assistant Examiner* — Andrew P Bainbridge
(74) *Attorney, Agent, or Firm* — Lucas & Mercanti, LLP

(57) ABSTRACT

A pouch with a nozzle has a reliable dispensing opening. The pouch holds liquid contents. The pouch has a shell portion formed by sealing two plies of plastic together to form a pouch volume and a nozzle portion which communicates with the inside of the shell portion. The nozzle portion is formed by a series of embossments which form a reliably open passage for dispensing fluid. Three sets of embossments include a plane shape, a dot shape or a line shape.

11 Claims, 11 Drawing Sheets

[Sectional View]

【A-A Sectional View】

【B-B Sectional View】

【C-C Sectional View】

[Sectional View]

【A-A Sectional View】

【B-B Sectional View】

【C-C Sectional View】

[Sectional View]

【A-A Sectional View】

【B-B Sectional View】

【C-C Sectional View】

[Sectional View]

【A-A Sectional View】

【B-B Sectional View】

【C-C Sectional View】

POUCH CONTAINER

This application is a 371 of PCT/JP2007/057929 filed Apr. 4, 2007, which claims the priority of JP 2006-106691 filed Apr. 7, 2006, both of which are hereby incorporated by reference.

BACKGROUND OF THE INVENTION

A. Field of the Invention

The present invention relates to a pouch container, e.g., a pouch for refilling contents in a subject container.

B. Description of the Related Art

A pouch container is used for refilling liquid, powder or grain contents in a subject container. For example, after contents such as detergent, bleach, softening agent, starch, shampoo, rinse, food oil, soy sauce and dressing in a subject container are used completely and the container becomes empty, the contents may be refilled. Liquid contents to be refilled are sold in the form of a refilling container. A pouch container is used as the refilling container.

A pouch container is formed by placing two film shell members or two film shell members with base members one upon the other and thermally sealing the peripheral portion to form a bag shape. A pouch container is constituted of a shell portion for accommodating contents and a nozzle protruding from the shell portion to discharge the contents. The shell portion and nozzle are formed by thermally sealing two shell members on their peripheral area. The nozzle is often formed at an upper end of the pouch or a corner of the pouch between the upper side and a vertical side.

Since the shell member of the pouch is a film material having small rigidity, the shape of the pouch container is not stable and tends to deform while a person holds it with one hand or both hands to refill the contents in a subject container. If the pouch, particularly the nozzle, is deformed, a fluid path in the nozzle may be blocked and the liquid contents cannot be discharged smoothly.

In order to ensure an open state of the liquid path of the nozzle, one of the front and rear shell member is embossed near at the nozzle to give some rigidity to the shell member and form a space for the path between the front and rear shell member (refer to JP-A-2001-97405). Another film formed with a rib is adhered to the shell member near at the nozzle to give rigidity to the nozzle to maintain an open state of the nozzle path in the nozzle (refer to JP-A-2005-67630).

According to the former technique of forming an emboss on one shell member, the shape of the emboss is simple so that sufficient rigidity cannot be given to the nozzle wall and it is not possible to maintain a good open state of the nozzle. According to the latter technique of adhering another film formed with a rib to the shell member, not only the number of components increases but also the number of manufacture processes increases.

It has been long desired to develop the open state maintaining technique capable of maintaining a good open state of a nozzle and having a simple structure without using additional members.

SUMMARY OF THE INVENTION

The present invention has been made in view of the above described circumstances. It is an object of the present invention to provide a pouch having a nozzle capable of maintaining a good open state of the nozzle with a simple structure.

To achieve the object, the present invention provides a pouch container for accommodating liquid contents, comprising: a shell portion formed by sealing stacked two shell members made of a pouch film raw materials; and a nozzle portion communicating with an inside of the shell portion, wherein emboss worked portions are formed on walls of the pouch in at least partial areas of the walls of the nozzle portion of the pouch constituted of the pouch raw materials, or in areas constituted of at least partial areas of the walls of the nozzle portion and at least partial areas of walls of the shell portion adjacent to the partial areas of the walls of the nozzle portion, and the embossment are portions of the walls of the pouch protruding to an outside and have a plane shape, a dot shape or a line shape in a line symmetric with, or asymmetric with, a center line of the nozzle portion on the walls of the pouch.

In the invention described in claim 1, since the embossment having a plane shape, a dot shape or a line shape are formed on the nozzle walls by an emboss work, it is possible to have desired rigidity of the nozzle portion and maintain the open state of the nozzle portion suitable for each type of the pouch, by using one of a combination of these shapes.

In the invention described in claim 2, by applying the present invention to a refilling pouch, a refilling pouch can be obtained which can discharge liquid contents at a stable flow rate.

In the embodiment described in claim 3, there is provided a combination of first, second and third embossment and an open cut line crosses plane shape embossment. Therefore, when the end portion of the nozzle portion is torn and opened along the open cut line, a discharge port is opened by all means to maintain a discharge state. The first embossment form a ridge line along the center line direction of the nozzle, the second embossment form subsidiary ridge lines on the walls on both sides of the first embossment to give rigidity relative to a lateral deformation by a load on the nozzle portion, and the third embossment give rigidity relative to crush of the nozzle portion. Since rigidity is given to the nozzle portion sufficiently, an open state of a liquid path in the nozzle can be ensured.

In the invention described in claim 4, since the first embossment have a straight line shape, it is easy to form the ridge lines of the nozzle portion.

In the invention described in claim 5, since the first embossment have a curved shape on a side nearer to a shell portion, it is easy to form a liquid path of the nozzle portion along a flow of liquid contents from the shell portion to the nozzle portion.

In the invention described in claim 6, the second embossment reach or do not reach the plan shape embossment. Optimum rigidity can be selectively given to the nozzle portion depending upon the type of the pouch.

In the invention described in claim 7, since the second embossment are coupled to common third embossment rigidity of the nozzle portion can be increased.

In the invention described in claim 8, although the third embossment are omitted, an open state of the liquid path can be maintained even if the shape of the nozzle portion is made simple depending on the type of the shell material.

In the invention described in claim 9, since the embossment are constituted of the plan shape embossment and the third embossment, there is rigidity relative to crush deformation of the nozzle portion and the open state of the liquid path can be maintained, even if the shape of the nozzle portion is made simple depending upon the type of the shell material.

In the invention described in claim 10, the first embossment are perfectly stacked upon the plane embossment. It is possible to maintain the open state of the liquid path without complicating the shape of the embossment.

In the invention described in claim 11, the first embossment have kinked line shape portions so that rigidity can be given relative to crush deformation of the nozzle portion.

In the invention described in claim 12, the first embossment have kinked line portions and the third embossment are coupled to apexes of the kinked line so that larger rigidity can be given relative to crush deformation of the nozzle portion In the invention described in claim 13, the embossment have a dot shape so that rigidity can be given to the nozzle portion even with a simple emboss work.

In the invention described in claim 14, the embossment are constituted of figures whose centers are on the center line. It is therefore possible to exhibit the functions of the plane shape embossment and the first to third embossment almost at the same time.

In the invention described in claim 15, it is easy to select desired rigidity depending upon the type of the pouch row material.

DESCRIPTION OF THE PREFERRED EMBODIMENTS

With reference to the accompanying drawings, description will be made on embodiments for carrying out the details of the present invention.

Figure 1:
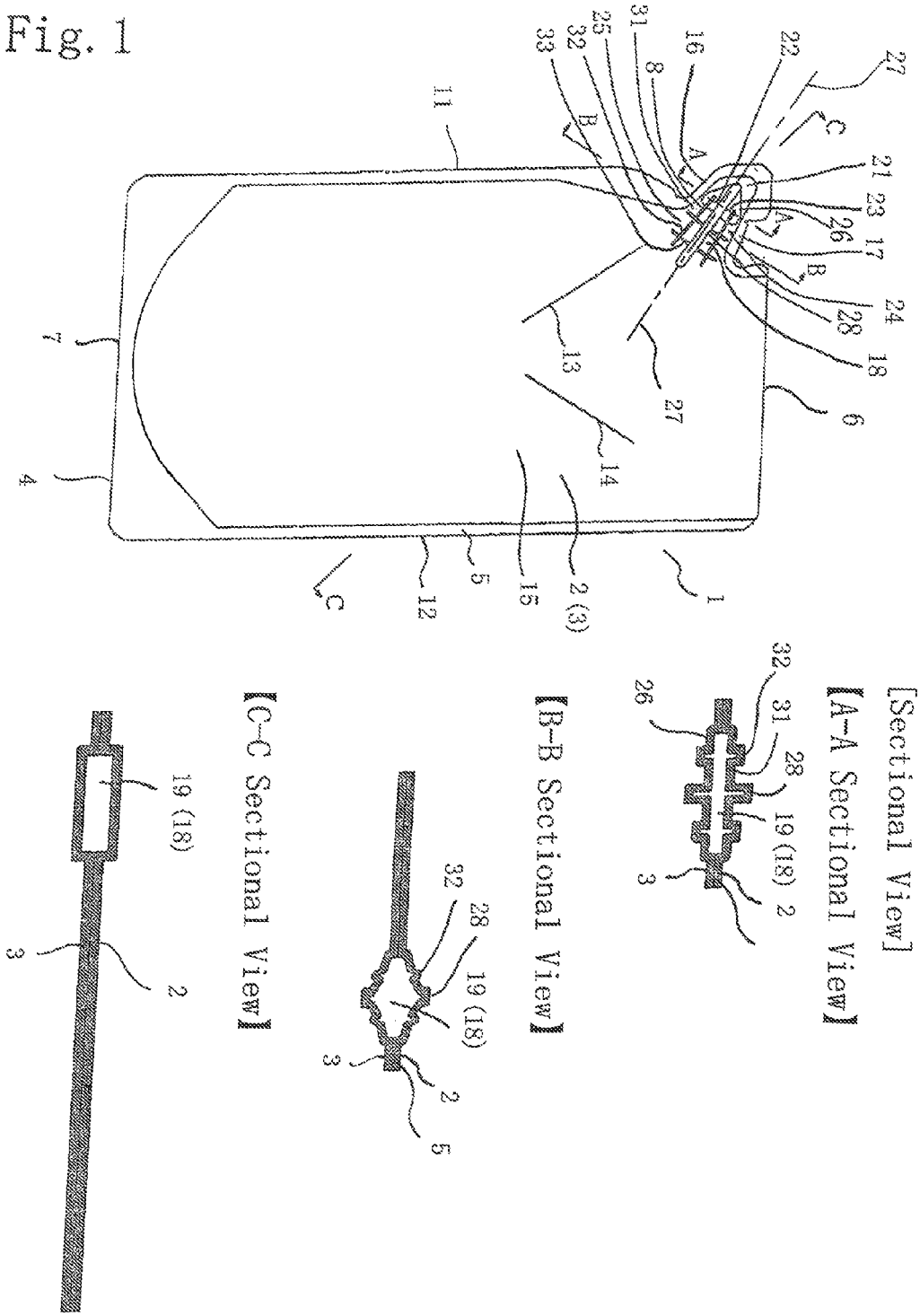
FIG. 1 is an illustrative diagram showing a pouch according to a first embodiment of the present invention.

In FIG. 1, reference numeral 1 represents a refilling pouch container (hereinafter abbreviated to a pouch 1). A pouch 1 is formed by placing two shell members 2 and 3 made of a pouch film raw material, if necessary, two shell members with base members 4, one upon the other and thermally sealing a heat seal portion 5 at the peripheral portion to form a bag shape. Although not specifically limited, the material of the shell members 2 and 3, particularly resin materials suitable for the pouch container, include: polyolefin such as crystalline polypropylene, crystalline propylene-ethylene copolymer, crystalline polybutene-1, polymethyl-4 pentene-1, low density polyethylene, middle density polyethylene, high density polyethylene, ethylene-vinyl acetate (EVA) copolymer, ethylene-ethyl acrylate (EEA) copolymer, and ionic bridge olefin copolymer (ionomer); aromatic vinyl copolymer such as polystyrene, and styrene-butadiene copolymer; vinyl halide copolymer such as polyvinyl chloride, and vinylidene chloride resin; acrylonitrile-styrene copolymer; nitrile polymer such as acrylonitrile-styrene-butadiene copolymer; polyamide such as nylon 6, nylon 66, and para-meta-xylylene adipamide; polyester such as polyehylene terephthalate, and polytetra methylene terephthalate; thermoplastic resin such as polyacetal such as polycarbonate and polyoxymethylene; and the like. The film pouch raw material described above is used by not drawing, by uniaxially drawing, or by biaxially drawing.

Each of the shell members 2 and 3 may be a single layer, or a lamination of two or more layers. One film pouch raw material may be used or a lamination of two or more film pouch raw materials may be used. One film pouch raw material may be used or a lamination of two or more film pouch raw materials may be used by attaching thereto a metal foil of aluminum or the like, a vapor deposition film of metal, metal oxide or the like, paper, cellophane, or the like. For example, a preferable film pouch raw material may be a two-layer structure of an outer layer of drawn nylon film and an inner layer of polyolefin such as low density polyethylene, a two-layer structure of an outer layer of drawn polyester film and an inner layer of polyolefin, a three-layer structure of these inner and outer layers and a metal foil layer of aluminum or the like interposed therebetween, or the like. In manufacturing the lamination film, adhesive and anchor agent may be involved between the layers, if necessary.

The pouch 1 has an upper side 6, a lower side 7, a left side 11 and a right side 12, and has a rectangular shape as viewed from the front side when contents are not still filled. When liquid contents are filled, the flexible pouch 1 is deformed so that externally swelling ridge lines 13 and 14 are formed on the shell members 2 and 3. The ridge lines 13 and 14 are kind of wrinkles formed from the central area of a shell portion 15 of the pouch 1 to right and left corner portions of the upper side 6, and have the function of giving rigidity to the pouch 1. This phenomenon of forming the ridge lines 13 and 14 is well known conventionally. A nozzle portion 8 of the pouch 1 is formed between the left side 11 and upper side 6. The nozzle portion 8 is sealed by a lower seal portion 16 and an upper seal portion 17 at the lower side thereof near the left side 11 and the upper side thereof near the upper side 6, respectively, to thereby form a hollow liquid path 18 between the shell members 2 and 3. The liquid path 18 communicates with the inside of the shell portion 15.

The nozzle portion 8 is formed protruding from the shell portion 15 to the external, and the top end thereof is closed by a tab 21. An open cut line 22 as an easy-to-open guide line is formed between the tab 21 and nozzle portion 8 over the liquid path 18. As the tab 21 is separated at the open cut line 22, a discharge port 23 which is a top end of the liquid path 18 is formed at the top end of the nozzle 8. The liquid path 18 has the discharge port 23 at its top end, and the bottom end communicates with the inside of the shell portion 15. When liquid contents are discharged via the nozzle portion 8, both the discharge port 23 and liquid path 18 are maintained open because the pressure of the liquid contents is large at the initial discharge stage. This state is desired to be maintained until the discharge end. However, there is a tendency that as the remaining amount of liquid contents reduces, the discharge port 23 and liquid path 18 are closed. The present invention pertains to the technique of maintaining the open state of the liquid path 18 until the discharge end.

Embossment 24 are formed on walls of the pouch 1 constituted of the shell members 2 and 3 in at least partial areas of walls of the nozzle portion 8 or in areas 25 constituted of at least partial areas of the walls of the nozzle portion and at least partial area of the walls adjacent to the partial areas of the nozzle walls. The embossment 24 are portions of the shell members 2 and 3 protruding from the inside to the outside. The embossment 24 of the shell member 2 is positioned facing the embossment 24 of the shell member 3 to form a space 19 having a predetermined thickness between the shell members 2 and 3.

The shape of the embossment 24 is a plane shape, a dot shape, a line shape or a combination thereof The shape of the embossment 24 is desired to be in a line symmetric with a center line 27 of the nozzle portion 8 projected upon the walls of the pouch 1, from the reason to be described later that a first embossment forms the ridge lines easily. However, asymmetric may also be adopted depending upon the kind of the shell members 2 and 3 of the pouch 1.

In the embodiment shown in FIG. 1, the embossment 24 form plane shape embossment 26 in the region which the open cut line 22 of the nozzle discharge port 23 in the areas 25 crosses, and line shape first embossment 28 along the direction of the center line 27. The first embossment 28 have a straight line shape. The embossment further form line shape second embossment 32 along the first embossment 28 in areas 31 on both sides of the first embossment 28, and in addition line shape third embossment 33 in a plane area 31 perpendicular to or crossing the first and second embossment 28 and 32. The first embossment 28 have the largest emboss height, the second embossment 32 have an emboss height smaller than that of the first embossment 28, and the third embossment 33 have an emboss height similar to that of the second embossment 32.

As shown in A-A, B-B and C-C cross sections shown in FIG.1, the nozzle portion 8 constructed as above has a space between the front and rear shell members 2 and 3, and the embossment 26, 28, 32 and 33 give rigidity to the nozzle portion so that the open state of the liquid path 18 can be maintained.

Figure 2:
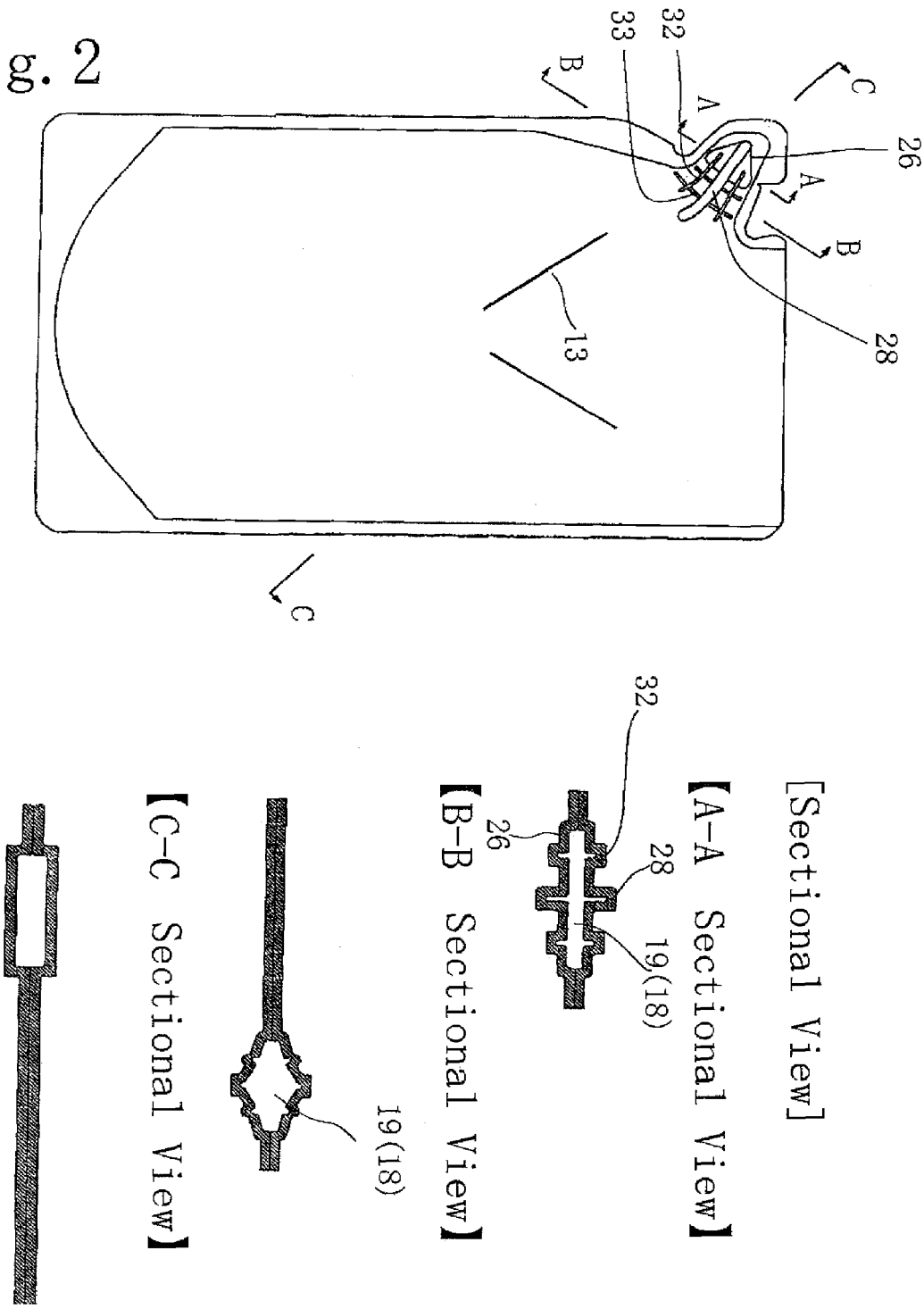
FIG. 2 is an illustrative diagram showing a pouch according to another embodiment of the present invention.

In the embodiment shown in FIG. 2, the shape of the first embossment 28 has a straight line shape on the external side of the nozzle portion 8 and a curved line shape in the end portion on the shell portion 15 side. In this case, it is easy to make the curved end portion be coincident with the direction of the ridge line 13 of the shell portion 15 so that the liquid contents can be easily discharged. The end portion on the shell portion 15 side may have a straight line shape directing toward the ridge line 13. In this case, this straight line portion may be coupled to the straight line portion on the external side of the nozzle portion 8, either by being bent or by being smoothly curved.

Figure 3:
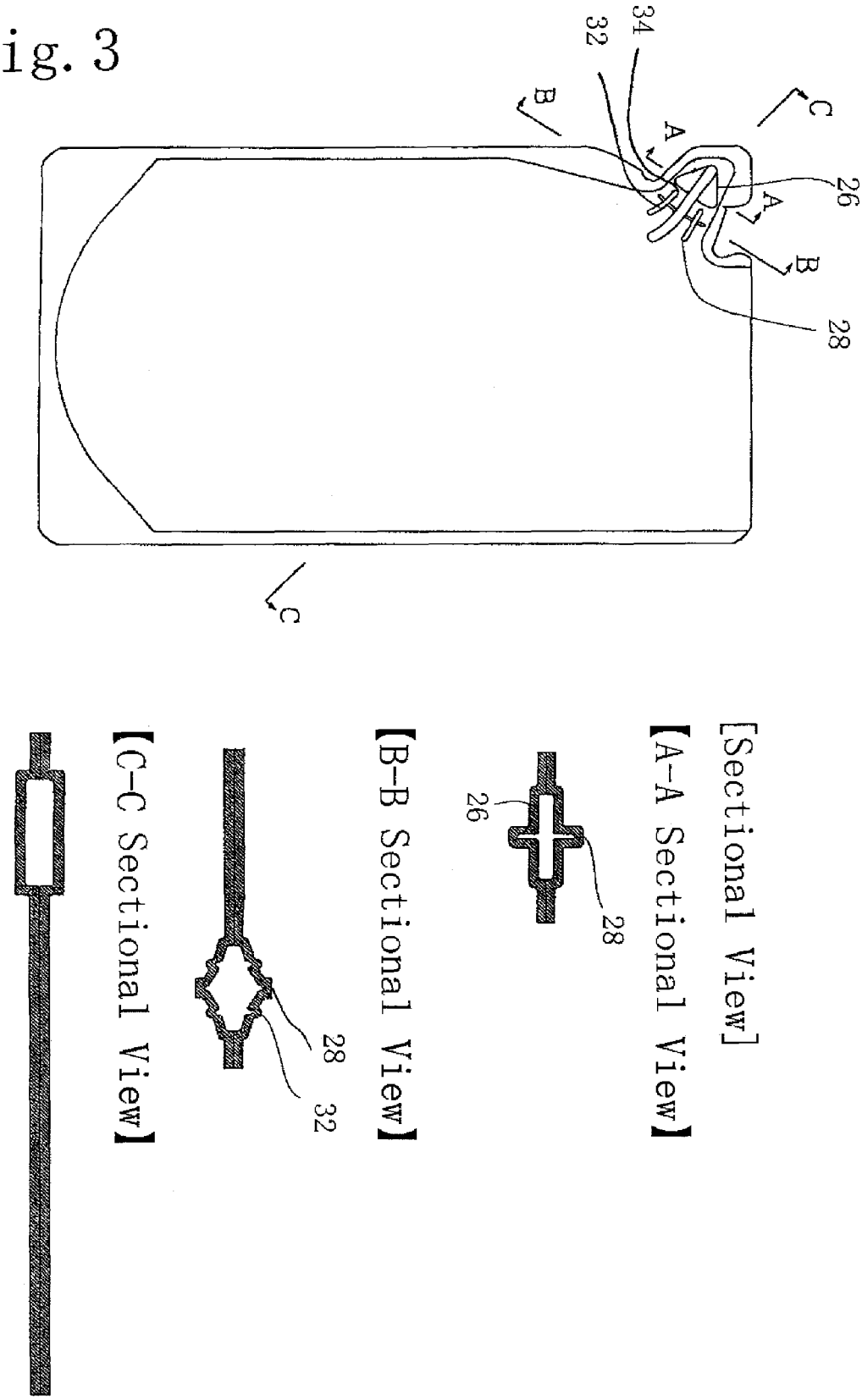
FIG. 3 is an illustrative diagram showing a pouch according to another embodiment of the present invention.

In the embodiment shown in FIG. 3, end portions 34 of the second embossment 32 are spaced apart from the plane shape embossment 26. The end portions 34 may contact the plane shape emboss portions 26 depending upon the kind of the pouch.

Figure 4:
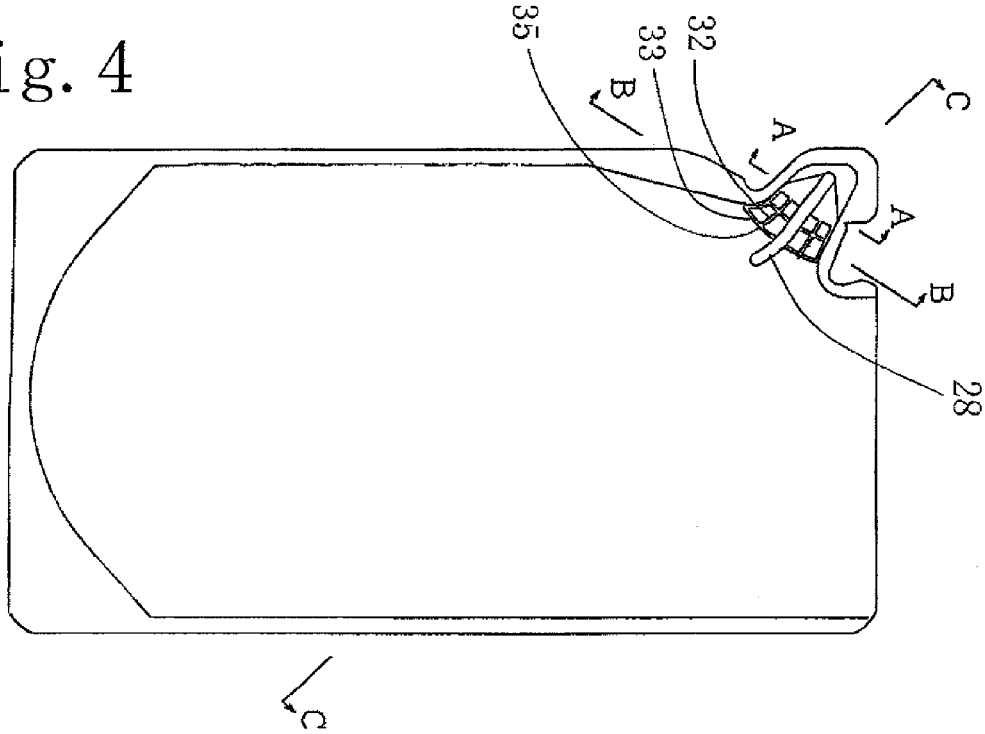
FIG. 4 is an illustrative diagram showing a pouch according to another embodiment of the present invention.
Figure 4:
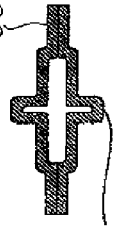
Figure 4:
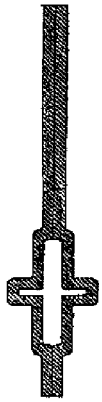
Figure 4:
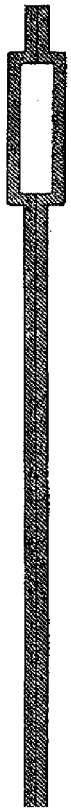

In the embodiment shown in FIG. 4, end portions 35 of the second embossment 32 on the shell portion 15 side reach the common third embossment 33 to increase rigidity of the nozzle portion 8. Depending upon rigidity of the shell members 2 and 3, the end portions 35 of the second embossment 32 may not be coupled to the common third embossment.

Figure 5:
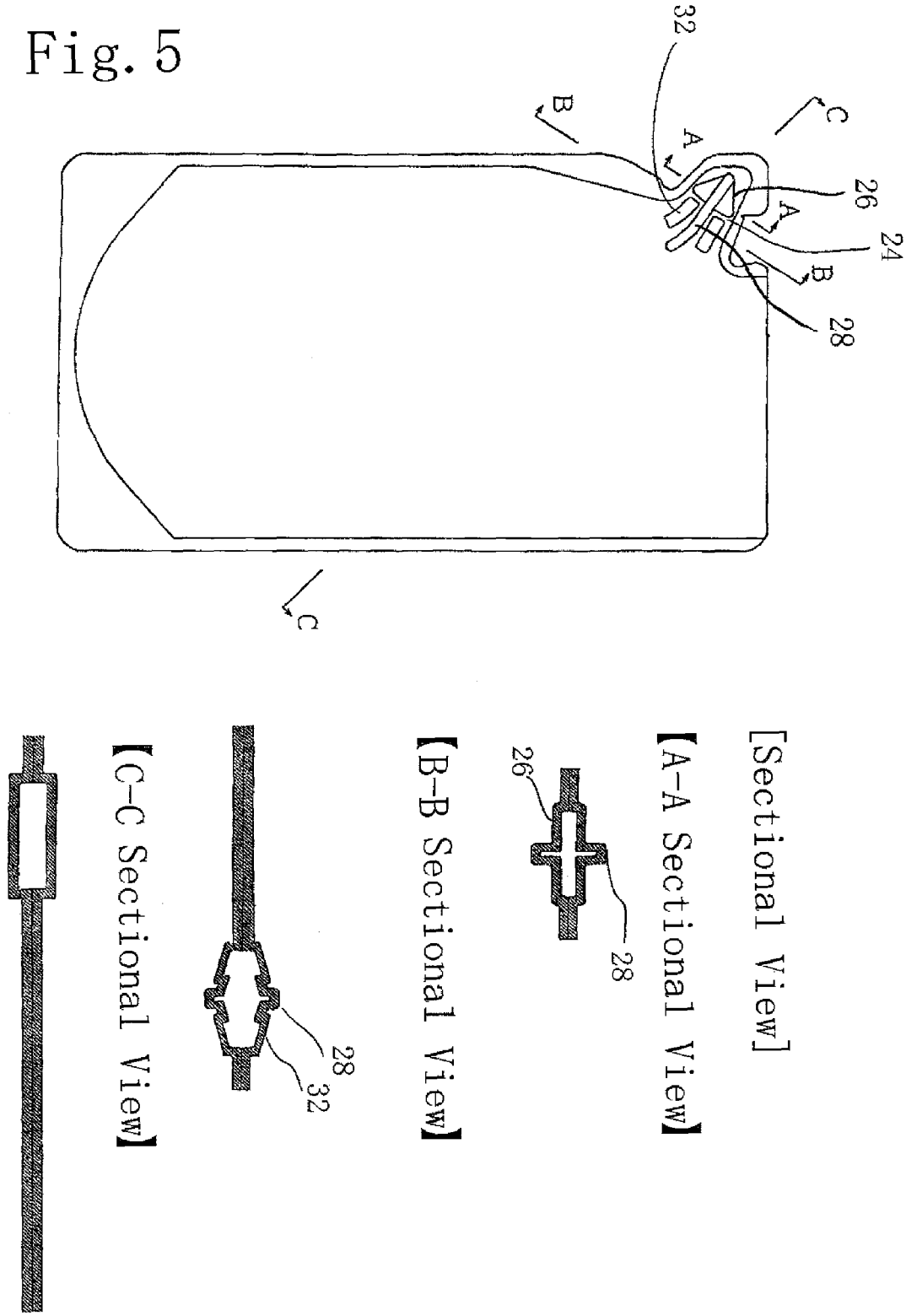
FIG. 5 is an illustrative diagram showing a pouch according to another embodiment of the present invention.

In the embodiment shown in FIG. 5, the embossment 24 are constituted of the plane shape embossment 26, first embossment 28 and second embossment 32. Widths of the second embossment 32 are set equal to or wider than those of the first embossment 28. Rigidity of the nozzle portion 18 can be increased even if the shape of the embossment 24 is simplified.

Figure 6:
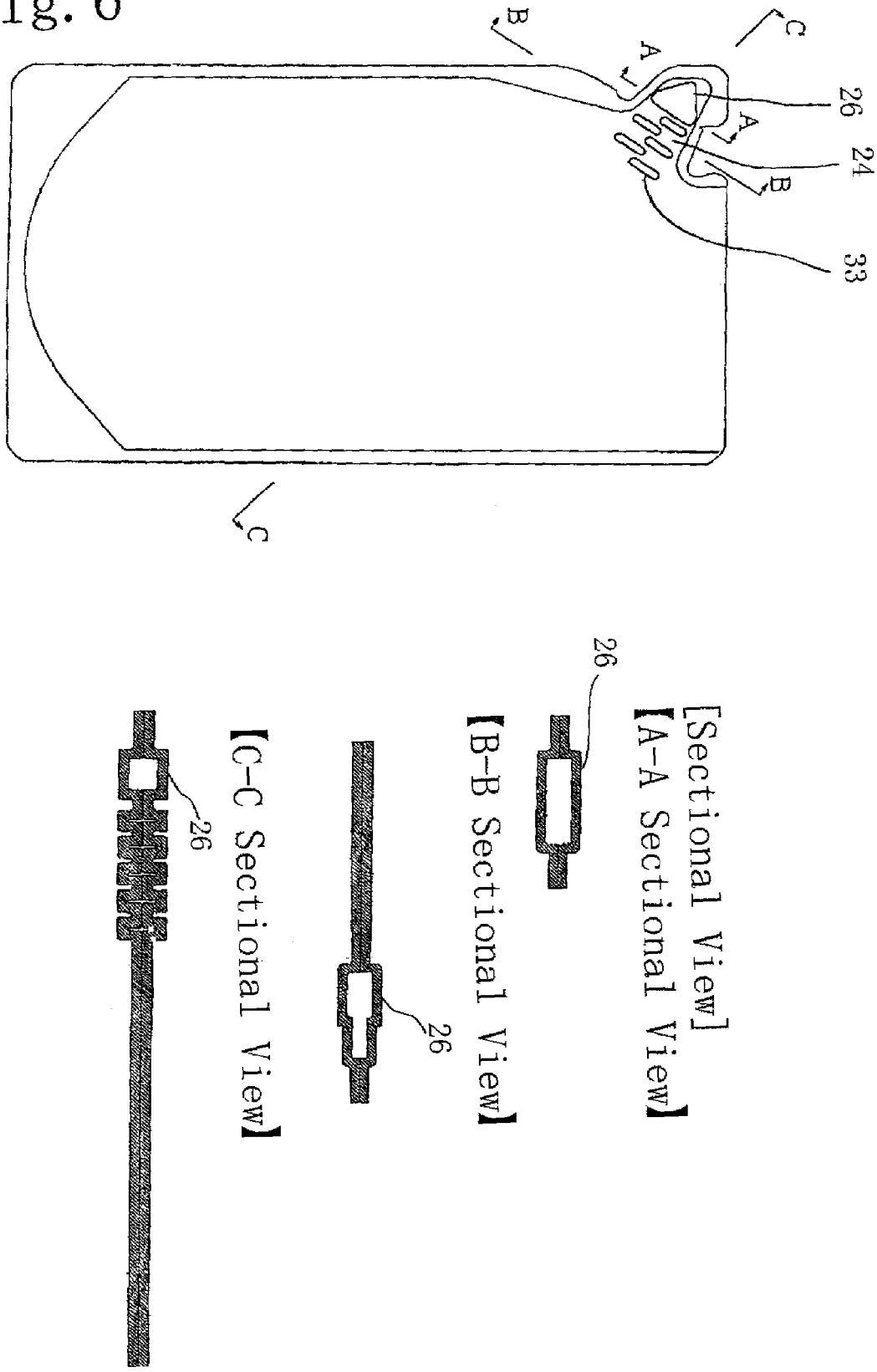
FIG. 6 is an illustrative diagram showing a pouch according to another embodiment of the present invention.

In the embodiment shown in FIG. 6, the embossment 24 are constituted of the plane shape embossment 26 and third embossment 33. It is therefore easy to change the shape of the nozzle portion relative to the direction of the front and rear shell members 2 and 3.

Figure 7:
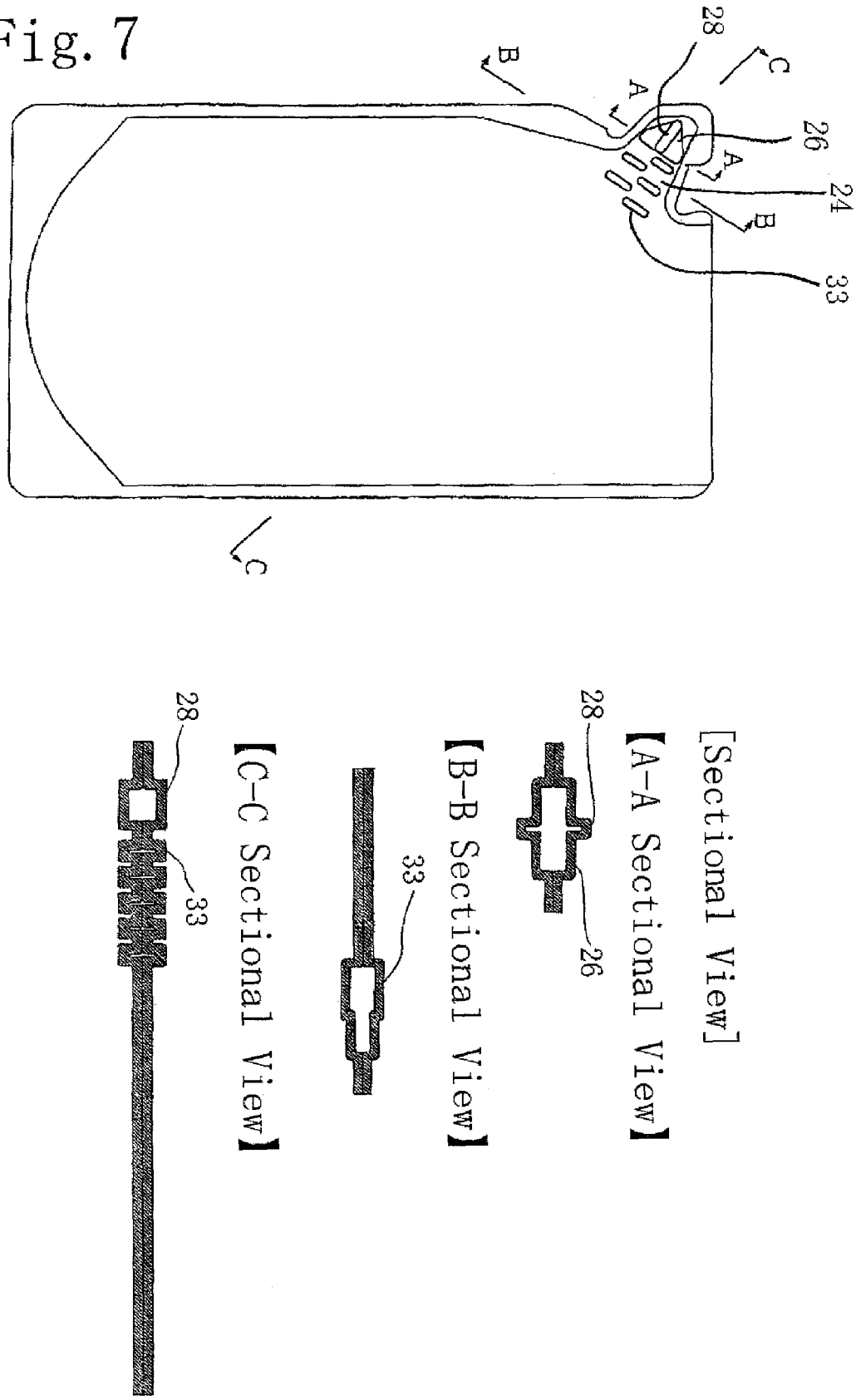
FIG. 7 is an illustrative diagram showing a pouch according to another embodiment of the present invention.

In the embodiment shown in FIG. 7, the embossment 24 are constituted of the straight line shape first embossment formed coincident with the plan shape embossment 26 and the third embossment 33 at the positions remote from the first embossment 28 Rigidity of the end portion of the nozzle portion 8 can be increased and it is easy to change the shape of the nozzle portion relative to the direction of the front and rear shell members 2 and 3.

Figure 8:
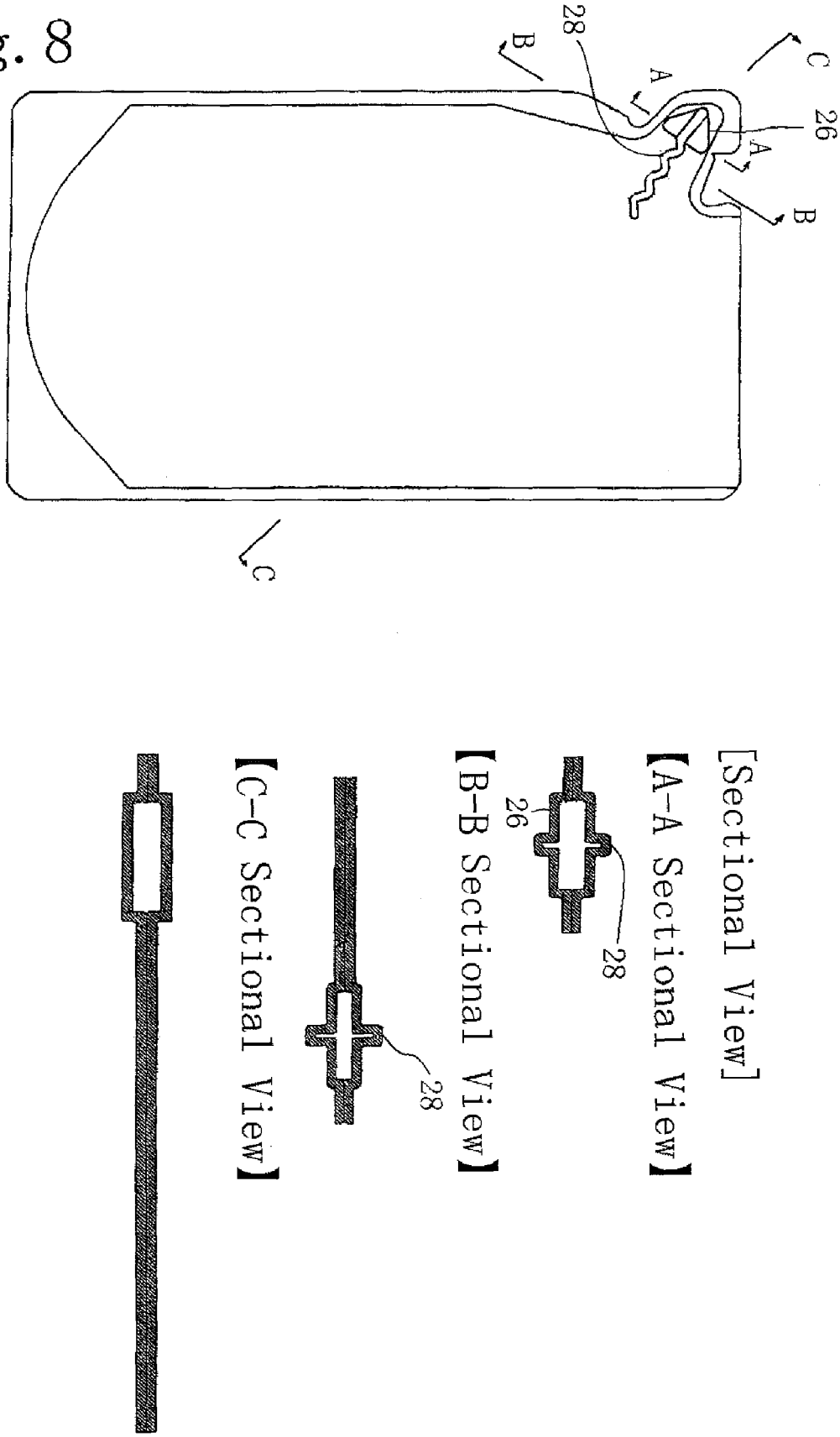
FIG. 8 is an illustrative diagram showing a pouch according to another embodiment of the present invention.

In the embodiment shown in FIG. 8, in the embossment, the first embossment 24 have a kinked line shape portion so that rigidity can be applied against the nozzle crush deformation.

Figure 9:
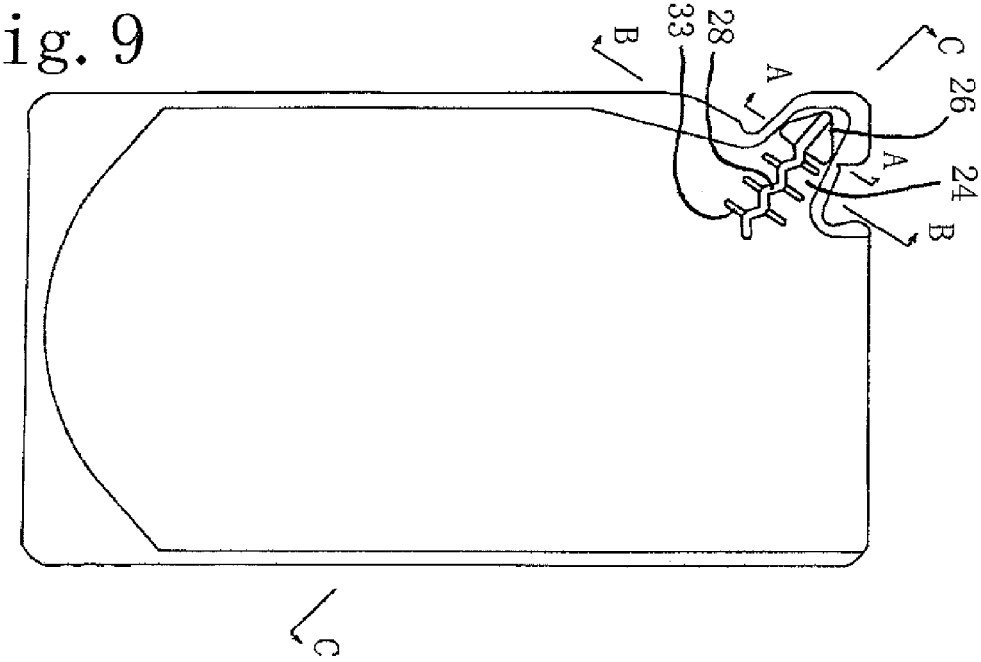
FIG. 9 is an illustrative diagram showing a pouch according to another embodiment of the present invention.
Figure 9:
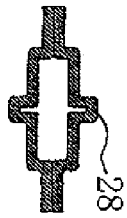
Figure 9:
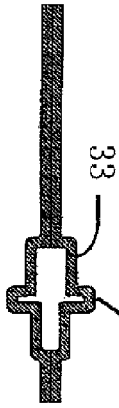
Figure 9:
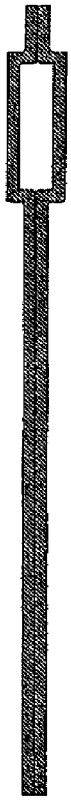

In the embodiment shown in FIG. 9, portions of the first embossment coupling the plane shape embossment 26 have a straight line shape, portions on the shell portion 15 side have a kinked line shape, and the third embossment 33 reach kinked points of the kinked line shape of the first embossment. Rigidity can be exhibited to a broad area of the first embossment 28.

Figure 10:
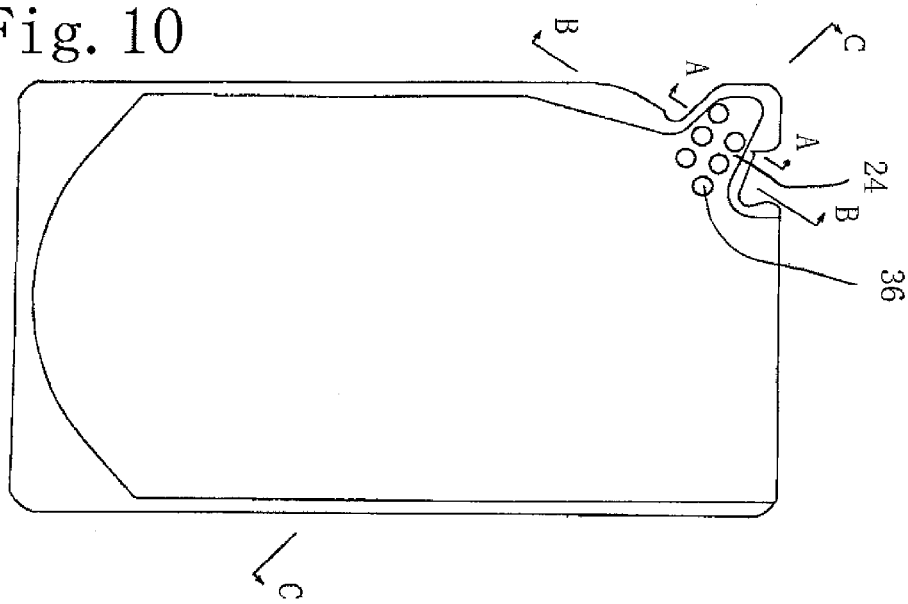
FIG. 10 is an illustrative diagram showing a pouch according to another embodiment of the present invention.
Figure 10:
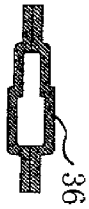
Figure 10:
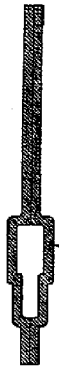
Figure 10:
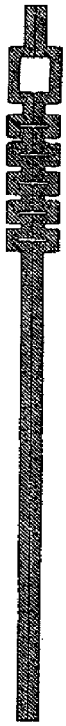

In the embodiment shown in FIG. 10, the embossment 24 are constituted of embossment 36 having a plurality of dot shape embosses. Rigidity can be exhibited with an easy emboss work.

Figure 11:
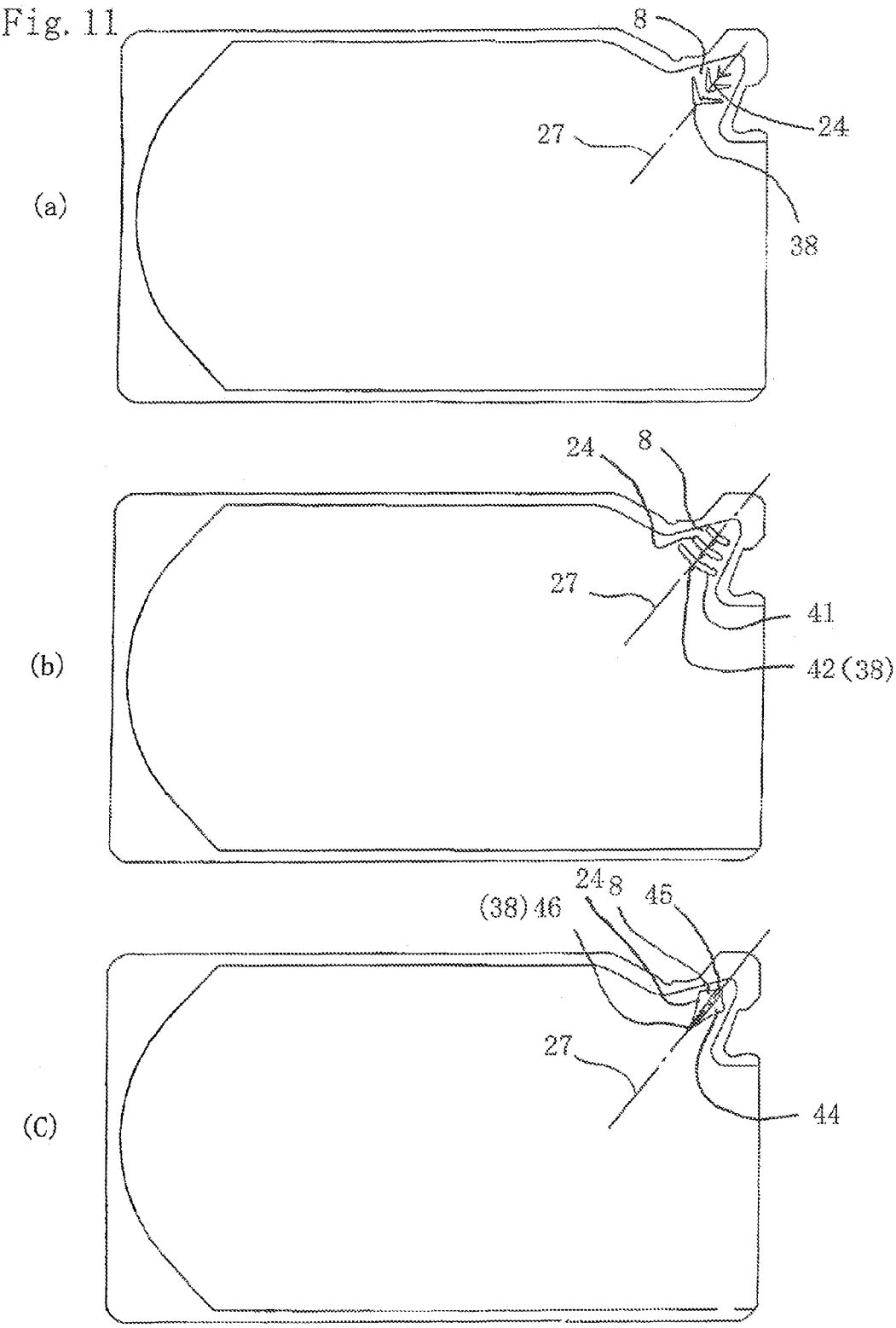
FIG. 11 is an illustrative diagram showing pouches according to other embodiments of the present invention.

In the embodiments shown in FIG.11, the embossment 24 are constituted of embosses of figures whose center and change point are set on the center line 27 of the nozzle portion 8. Because the change points are set on the center of figure, it is easy to form the ridge on the nozzle portion 8.

In the embodiment indicated at (a) in FIG.11, the embossment 24 are constituted of a plurality of embosses of similar paired wing figures, and a middle of two wings constitutes a change point38. In the embodiment indicated at (b) in FIG.11, the embossment 24 are constituted of a set of similar FIGS. 43 made of arc portions 41 and projection portions 42 projecting from the arc portions. The projection portion 42 constitutes the change point 38.

In the embodiment indicated at(c) in FIG.11, each of the embossment 24 is constituted of a single rectangular FIG. 44, and upper and lower comers 45 and 46 constitute change points 38.

According to the present invention, since the embossment having a plane shape, a dot shape or a line shape are formed on the nozzle walls by an emboss work, it is possible to have desired rigidity of the nozzle portion and maintain the open state of the nozzle portion suitable for each type of the pouch, by using one of a combination of these shapes. Rigidity necessary for maintaining an open state of the nozzle portion can be selectively given if the shape of the embossment is made line symmetric or line asymmetric with the nozzle center line on the pouch walls. There is provided a combination of the plane shape embossment and the first to third emboss worked portions and the open cut line crosses the plane shape emboss worked portions. Therefore, when the end portion of the nozzle portion is ton and opened along the open cut line, a discharge port is opened by all means to maintain a discharge state. The first embossment form a ridge line in the direction of the center line direction of the nozzle, the second embossment form subsidiary ridge lines on the walls on both sides of the first embossment to give rigidity relative to a lateral load deformation of the nozzle portion, and the third embossment give rigidity relative to crush of the nozzle portion. Since rigidity is given to the nozzle portion sufficiently, an open state of a liquid path can be ensured. Since the first embossment have a straight line shape, it is easy to form the ridge lines of the nozzle portion. Since the first embossment have a curved shape on a side nearer to a shell portion, it is easy to form a liquid pass of the nozzle portion beside a flow line of a flow of liquid contents from the shell portion to the nozzle portion.

The second embossment reach or do not reach the plane shape embossment. Optimum rigidity can be selectively given to the nozzle portion depending upon the type of the pouch.

Since the second embossment are coupled to common third embossment, rigidity of the nozzle portion can be increased.

In case that the third embossment are omitted, an open state of the liquid path can be maintained even if the shape of the nozzle portion is made simple depending on the type of the shell material If the embossment are constituted of the plane shape embossment and the third embossment, there is rigidity relative to crush deformation of the nozzle portion and the open state of the liquid path can be maintained, even if the shape of the nozzle portion is made simple depending upon the type of the shell material.

If the first embossment are perfectly stacked upon the plane embossment it is possible to maintain the open state of the liquid path without complicating the shape of the embossment.

If the first embossment have kinked line shape portions and if the third embossment are coupled to apexes of the kinked line, rigidity can be given relative to crush deformation of the nozzle portion. If the embossment have a dot shape, rigidity can be given to the nozzle portion even with a simple work.

If the embossment are constituted of figures whose centers are on the center line, it is possible to exhibit the functions of the plane shape embossment and the first to third embossment almost at the same time.

As apparent from the foregoing description of the present invention, the present invention can provide a pouch with a nozzle which can maintain a good open state of the nozzle portion with a simple structure.

What is claimed is:

1. A pouch container for accommodating liquid contents, comprising:

a shell portion formed by sealing stacked plys made of pouch raw materials; and a nozzle portion communicating with an inside of the shell portion, said nozzle portion having a center line extending there through and having an open cut line crossing said center line forming a nozzle discharge port when torn, wherein embossments are formed on the walls of said pouch in at least partial areas of said nozzle portion, or in at least partial areas of the walls of said nozzle portion or in at least partial areas of said shell portion adjacent to the partial areas of the walls of said nozzle portion, said embossments protruding outward from the pouch center with a plane shape, a dot shape, or a line shape, symmetric or asymmetric with said center line, and wherein the shape of said embossments are in said plane shape formed in said region where said open cut line of said nozzle discharge port crosses said center line, said plane shape including:

a line shape first embossment having portions formed extending in a direction of said center line;

a line shape second embossment formed beside said first line shape embossment in an area located on both sides of said line shape first embossment; and a line shape third embossment formed to cross said first and second embossments in areas located on both sides of said line shape first embossment.

2. The pouch container according to claim 1, wherein the pouch container is a refilling pouch container for refilling the liquid contents in a subject container.

3. The pouch container according to claim 1, wherein said line shape third embossment is formed to cross said first and second line shape embossments perpendicular to said second and third line shape embossments.

4. The pouch container according to claim 1, wherein a shape of said line shape first embossment is a straight line shape.

5. The pouch container according to claim 1, wherein said line shape first embossment has end portions and said end portions of said line shape first embossment are located on an external side of said nozzle portion having a straight line shape, and said end portions of said line shape first embossment on the said shell portion side have a curved shape.

6. The pouch container according to claim 1, wherein said said line shape second embossment has end portions and said end portions of said line shape second embossment are located on said external side of said nozzle portion and reach said plane shape embossment.

7. The pouch container according to claim 1, wherein said line shape second embossment has end portions and said end portions of said line shape second embossment are located on said shell portion side and reach said common line shape third embossment.

8. The pouch container according to claim 1, wherein said shape of said embossments comprises: said plane shape embossment formed over the center line in areas where said open cut line of said nozzle discharge port crosses; and said line shape third embossment formed in a region not reaching said plane shape embossment along a line generally perpendicular to or crossing the center line.

9. The pouch container according to claim 1, wherein said shape of said embossments comprises: said line shape first embossment formed in a straight line shape in areas where said plane shape embossment in a region where said open cut line of said nozzle discharge port crosses, is formed; and said line shape third embossment formed in a region not reaching said plane shape embossment along a line generally perpendicular to or crossing the center line.

10. The pouch container according to claim 1, wherein the shape of said embossments comprises: said plane shape embossment formed in said region where said open cut line of said nozzle discharge port crosses; said line shape first embossment having straight line shape portions reaching said plane shape embossment and zigzagged line shape portions on a side nearer to said shell portion; and said line shape third embossment reaching said zigzagged portions of the said zigzagged line shape of said line shape first embossment.

11. The pouch container according to claim 1, wherein said line shape second embossment has end portions and said end portions of said line shape second embossment located on said shell portion side do not reach said common line shape third embossment.

* * * * *

UNITED STATES PATENT AND TRADEMARK OFFICE

CERTIFICATE OF CORRECTION

PATENT NO. : 8,485,400 B2
APPLICATION NO. : 12/282097
DATED : July 16, 2013
INVENTOR(S) : Kawakami et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1169 days.

Signed and Sealed this
Eighth Day of September, 2015

Michelle K. Lee

Michelle K. Lee
*Director of the United States Patent and Trademark Office*